United States Patent [19]

Fontvieille

[11] 3,972,766

[45] Aug. 3, 1976

[54] APPARATUS FOR FABRICATING FLAT OBJECTS

[76] Inventor: André Fontvieille, 20, Place Turenne, 59240 Dunkerque, France

[22] Filed: Jan. 17, 1975

[21] Appl. No.: 542,081

[52] U.S. Cl. ..... 156/358; 100/50; 156/382; 156/580

[51] Int. Cl.[2] ..... B30B 15/16

[58] Field of Search ..... 156/103, 104, 285, 286, 156/299, 312, 323, 580, 583, 358, 382, 581; 100/42, 43, 50, 211

[56] References Cited

UNITED STATES PATENTS

| | | | |
|---|---|---|---|
| 3,453,166 | 7/1969 | Herriott et al. | 100/211 |
| 3,554,834 | 1/1971 | Bennett et al. | 156/285 |
| 3,738,890 | 6/1973 | Johnson et al. | 156/286 |
| 3,873,395 | 3/1975 | Ehrlich | 100/211 |

*Primary Examiner*—Douglas J. Drummond
*Assistant Examiner*—Jerome W. Massie
*Attorney, Agent, or Firm*—Oblon, Fisher, Spivak, McClelland & Maier

[57] ABSTRACT

The invention concerns a method and a press arrangement in which a panel is compressed between two heated plates of a press, and in which a vacuum is created between the two plates of the press during compression, one of the plates being flexible along one direction, wherein the curved flexible plate is applied to the panel to be pressed so that it contacts the panel on an elongated surface near a generatrix, the air pressure in the press around the panel is gradually lowered while the flexible plate is progressively developed to shape it into planar form, pressure is exerted on more and more surface starting from the surface of initial pressure so as to exert pressure over the entire surface of the flexible plate in order to shape it into planar form when the desired low pressure is attained.

5 Claims, 3 Drawing Figures

APPARATUS FOR FABRICATING FLAT OBJECTS

BACKGROUND OF THE INVENTION

1. Field of the Invention

The invention concerns a method and arrangement for control of a press for fabricating flat objects such as laminated panels having at least one surface layer of thermoplastic or thermosetting material. It is aimed more especially at presses usable for laminates, the top and/or bottom layer of which is finished, i.e. obtained by transformation of a liquid by polymerization. This procedure is different from and more difficult and delicate to carry out than the simple gluing together of several thicknesses of material impregnated with binder, glue or plastic resin.

2. Description of the Prior Art

Methods involving thermoplastic materials or ones thermosettable from the liquid state are known. In such methods, the object is compressed between the two plates of a heated press, one of the plates being fixed and the other, usually the upper one, being movable vertically with respect to the first.

In such methods, there is great difficulty in removing air trapped between the laminations during pressing. Various methods have been proposed for doing this. In one of them, the press has sealing flanges around its periphery. When the plates approach one another, the space between them becomes sealed off and the air is pumped out to produce as low a pressure as possible so as to induce the release from the surface of the softened plastic material the air trapped in it at atmospheric pressure. These methods have not proved satisfactory since the vacuum produced inside the press causes too rapid a forceful clamping of the plates against each another which impedes the escape of air.

In another known method, the press has one rigid plate while the other is flexible in one dimension. The flexible plate, which may be of slightly supple sheet steel, possibly reinforced in one direction by parallel straight rigid elements, js brought into contact, while curved, along a generatrix, preferably central. The flexible plate is then progressively unbended to yield a planar shape so as to increase the contact surface. In spite of the magnitude of the pressures used, these methods have not been satisfactory. Examination of the surface of the products obtained reveals numerous air bubbles in the mass of the plastic. Not only is the surface not smooth, which causes it to attract dirt and makes it more difficult to clean, but the structural solidity of the product is affected.

Also, the high pressures used only permit the realization of compact high density panels. With these methods and arrangements it is not possible to produce an insulating panel with a porous layer.

It has also been attempted in the past to combine two methods, i.e. to use a press, one plate of which is flexible, the two plates having a sealing joint around their periphery, with means being provided to evacuate the space between the plates when the plates are sufficiently close to one another to make the seal effective. Desirable results have not been possible thus far because if the vacuum is high enough, the flexible plate flattens out against the laminate and impedes the escape of occluded air.

The means for forcing the flexible plate, which in practice is always the upper one, against the object to be fabricated consist of a multitude of jacks, hydraulic or pneumatic, of which only certain ones acting along the line of initial contact of the plate with the object, generally along an axis of symmetry of the plate, assure the reflexing of the plate and support it in the raised position of the press.

It has been found in operation that it is difficult to perfectly synchronize the set of lifting jacks. It has been found further that the upper plate can assume positions skewed with respect to its normal orientation so that binding of some jacks can occur with the result that their connections to the upper plate can break.

The procedures utilizing means for producing a vacuum also have the serious drawback of the difficulty of opening the press. When the vacuum inside the press is broken, the air cannot penetrate between the plates which remain tightly clamped together and it takes enormous forces to pull them apart. Moreover, damage to the laminated product can result. In addition, the synchronization of the set of jacks during the reflexing displacement is more difficult the larger the forces with the result that there frequently occurs a binding of the jacks, accompanied by the drawbacks indicated above.

SUMMARY OF THE INVENTION

It is therefore a goal of the present invention to offer a method and an arrangement which permit making low density panels under moderate pressures in just one operation without leaving air trapped in the surface layers of the panels.

It is another goal of the present invention to remedy the drawbacks noted above and to offer a method and an arrangement permitting easy removal of the product from the press and reflexing of the upper plate without the risk of binding.

The foregoing and other objects are attained in accordance with one aspect of the present invention, through the provision of a method and a press arrangement in which a panel is compressed between two heated plates of a press, and in which a vacuum is created between the two plates of the press during compression, one of the plates being flexible along one direction, wherein the curved flexible plate is applied to the panel to be pressed so that it contacts the panel on an elongated surface near a generatrix, the air pressure in the press around the panel is gradually lowered while the flexible plate is progressively developed to shape it into planar form, pressure is exerted on more and more surface starting from the surface of initial pressure so as to exert pressure over the entire surface of the flexible plate in order to shape it into planar form when the desired low pressure is attained.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which.

DETAILED DESCRIPTION OF THE PREFERRED EMBODIMENTS

Figure 1:
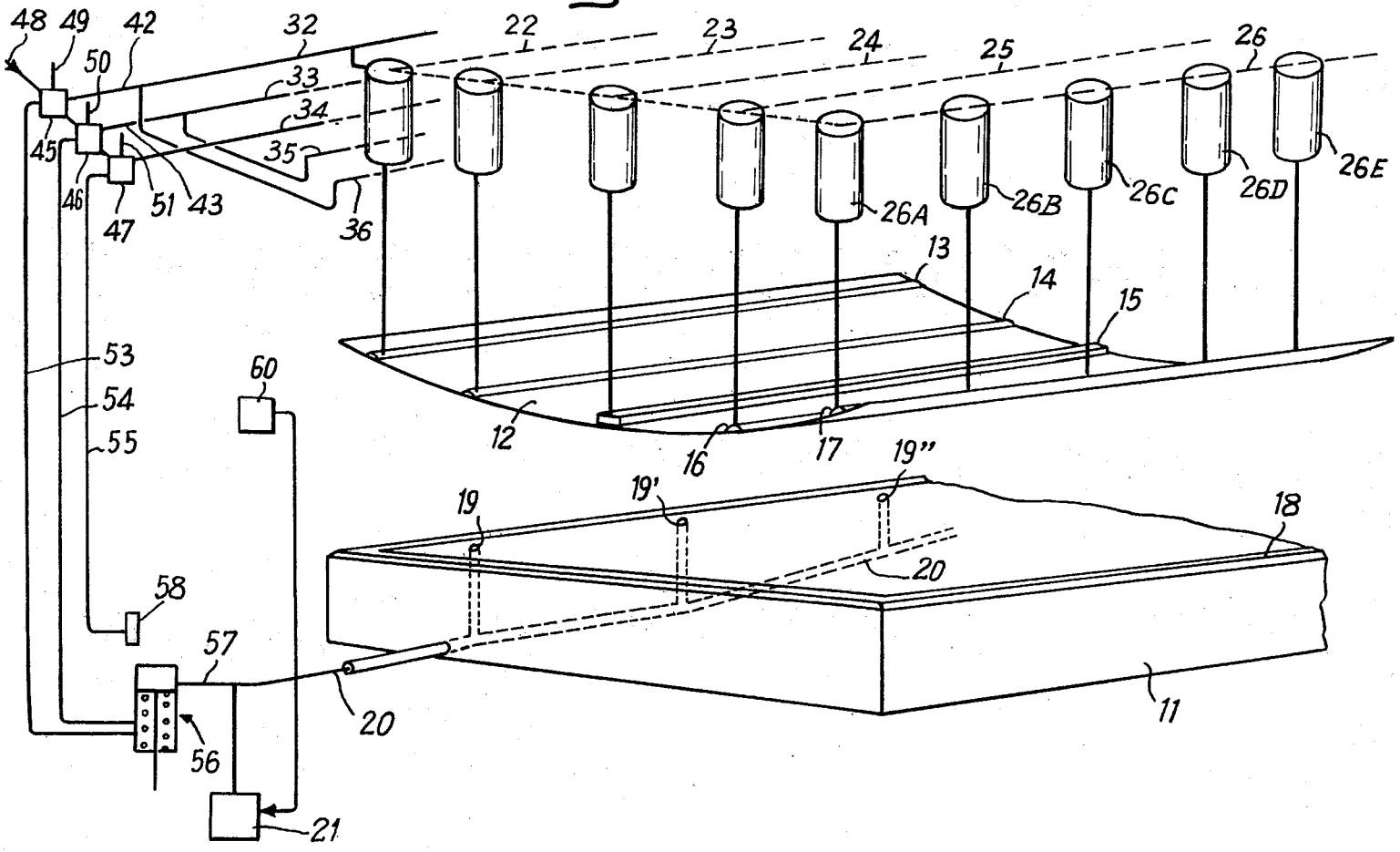
FIG. 1 is a schematic view in perspective of a press equipped with a control arrangement according to the invention.

Referring now to the drawings, wherein like reference numerals designate identical or corresponding parts throughout the several views, and more particularly to FIG. 1 thereof, the press of the invention has a lower plate 11 which is flat and rigid and an upper plate 12 which is flexible in one dimension. In numerous applications, a rectangular shape will be of interest and the upper plate will be chosen to be flexible about generatrices oriented along the length of the plate. Thus, the upper plate is reinforced by the rigid straight profiles, 13, 14, 15, 16 and 17, the number of such profiles being selected as a function of the width of the press and the pressures which must be exerted thereon. The lower plate has a peripheral seal 18, thick enough, or inflatable, to mate with the edge of the upper plate, which can be provided with suitable facing for realizing a seal around the space between the two plates. Orifices 19, 19′, 19″ are provided on the circumference of the lower plate and are connected by line 20 to a suction pump 21. Obviously the arrangement could be different without going beyond the bounds of the invention. For example, the orifices for evacuation could be on the upper plate, etc. The plates may have heating elements, steam or electric, of any suitable type, depending on local resources and the temperatures to be attained.

The displacements and deformations of the upper plate are controlled by the rows of jacks 22, 23, 24, 25 and 26, each row comprising a certain number of jacks, for example 26A, 26B, 26C, 26D, etc. spaced on lines along the length of the press. The number of jacks along the width, i.e. the number of rows, is selected depending on the width of the press, and according to the invention, will be at least three and preferably five or more depending on the width of the laminated panels to be made. In the example shown in the figure, each row of jacks corresponds to a reinforced profile of the upper plate. Obviously, there may be a larger number of profiles and it is preferable, in any case, that the rod of a jack act on the plate at right angles to a profile.

In the present form or embodiment, all the jacks are double acting pneumatic jacks and their upper ends in each row are connected to conduits, 32 in row 22, 33 in row 23, 34 in row 24, 35 in row 25 and 36 in row 26. In the example chosen, there is an odd number of rows and there is thus a central row and on each side there are equal numbers of rows symmetrically disposed. The invention is obviously applicable with an even number of rows of jacks. As will be seen, two symmetrically disposed rows function together. This is why the conduits 32 and 36 connect to a single conduit 42 and the conduits 33 and 35 connect to a single conduit 43. The conduits 42, 43 and 34 are controlled by the valves 45, 46 and 47 respectively, so that they can be connected to a source 48 of fluid under pressure or opened to the atmosphere at 49, 50, 51. The valves 45, 46 and 47 are servovalves, solenoid valves, pneumatic, mechanical or other type valves and are controlled by way of lines 53, 54 and 55 by any convenient means, electric, pneumatic, mechanical linkages or the like. The valves 45 and 46 are connected through manometer 56 and conduit 57 to the interior of the press, for example, by way of conduit 20. The valve 47 is controlled by manual control 58.

To simplify the figure for the sake of clarity, the supply and purge lines of the lower ends of the jacks have not been shown.

According to the present invention, the arrangement functions as follows. An object to be pressed, such as a laminated slab covered on its upper surface, and possibly on its lower surface also, with liquid resin polymerizable by heat is placed on the lower plate 11. The plates are suitably heated. The manual control 58 is then actuated, the effect of which is to open valve 47 and feed the central line of jacks 24 by way of conduit 34, the upper plate taking a convex shape as shown in FIG. 1. The plate 12 descends until the portion at right angles to the central profile 15 touches, over its entire length, the panel lying on plate 11. The descent of plate 12 is then stopped. The height of band 18 is such that, with the curvature of plate 12, it will make contact in this position with the edges of plate 12 and the seal realized. The pump 21 is then activated to begin the progressive evacuation of the interior of the press, and this, in accordance with the invention, at a well-measured rate, not too fast, so as not to induce too rapid deformation of plate 12, which would prevent the escape of air if forced too quickly against the laminate. The vacuum pump may be started manually or by a position detector 60 which signals the stopping of the jacks 24 in their low position. Since the press may handle laminated panels of different thicknesses, it may be advantageous to use a pneumatic sensor connected to the purging conduit of the lower end of jack 24. During the descent, an overpressure due to leakage maintains a certain overpressure in the conduit. When the jack stops moving, the overpressure in the conduit falls to zero in ½ second. The pressure sensor then gives a signal which starts the vacuum pump 21.

Because of the progressive evacuation of the interior of the press, the upper plate flattens out gently, being retained by the peripheral joint and the lateral jacks. The plate acts as a debubbler, forcing the air towards the exterior.

When the pressure is lowered to a certain level, for example by a 30 percent drop, the manometer 56 gives an order to open valve 45 to apply pressure to the jacks of the intermediate rows 23 and 25. Finally, when the pressure inside the press is lowered again, for example to 50 percent, the manometer 56 causes valve 45 to open applying pressure to the jacks in the outer rows 22 and 26. The upper plate becomes practically flat, all the jacks pushing on the plate so that it fits against the frame of the mold.

With the arrangement described above, the pressure due to evacuation is about 500 g/cm$^2$; and that exerted by the jacks alone is of the order of 1.2 to 1.5 kg/cm$^2$. Thus, a total of about 1.8 kg/cm$^2$ is exerted on the panel. Such pressures permit limiting the crushing of the panel, while obtaining, because of the gradual way in which the pressure is applied, a perfect surface free of defects. In particular, it is possible to obtain panels having a porous or cellular layer without crushing. These panels can have many uses, as, for example, the sides of containers, insulating or not, and can advantageously replace aluminum or steel sheet, being just as resistant, and also lighter and more insulating and less expensive.

The employment of the invention has been described with regard to a form of realization which makes use of a manometer for controlling the valves of the jacks. This device is not however, indispensable; what is important is the synchronization of the lowering of the air pressure with the successive descents of the rows of jacks, from the center to the outside. Thus, with a vacuum pump of known characteristics, and for a press of given dimensions it is possible to know with sufficient precision the time variation of the pressure in the press and program the descents of the rows of jacks accordingly. In another version, the jacks can descend successively, the stopping of one row at the end of its travel initiating the descent of the neighboring row with the help of a pneumatic sensor, provided that the times of descent of the jacks are preset, by choosing the actuating pressure, so as to stagger the descents of the rows of jacks in time to follow the lowering of the air pressure.

According to the invention, the surface of contact of the flexible plate is essentially proportional to the lowering of the pressure inside the press. Thus, it is similar to what is obtained if the descent of rows 23 and 24 is initiated when the pressure has been lowered by 30 percent and the descent of the outer rows is initiated when the pressure has been lowered 50 percent.

Figure 2:
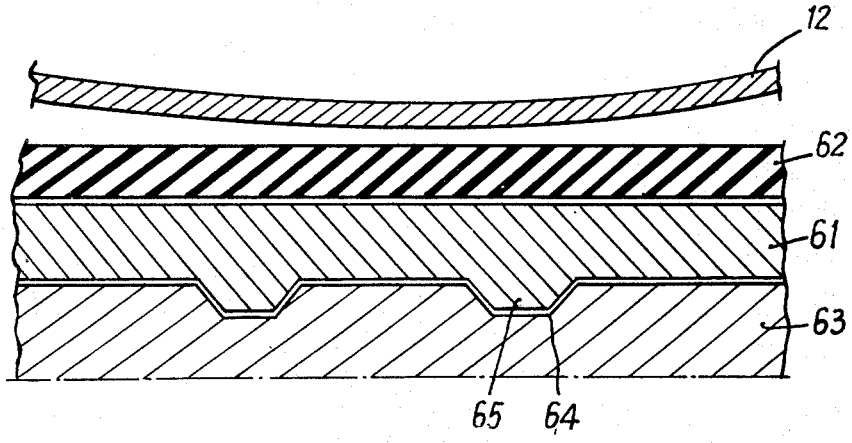
FIG. 2 is a partial transverse section of another embodiment of the invention.

In a variant of the realization of the invention, shown in partial transverse section in FIG. 2, there is placed, between the upper plate 12 and the laminated product 61, a sheet of supple rubber of given thickness. This technique permits an even more gradual application of pressure. As a variation, the sheet of rubber could be replaced by an inflatable cushion. These variations are particularly advantageous in the case of fabricating nibbed panels as shown in FIG. 2. The lower plate 63 of the press has cavities, hollows or the like 64 forming nibs 65 on the panel 61.

Figure 3:
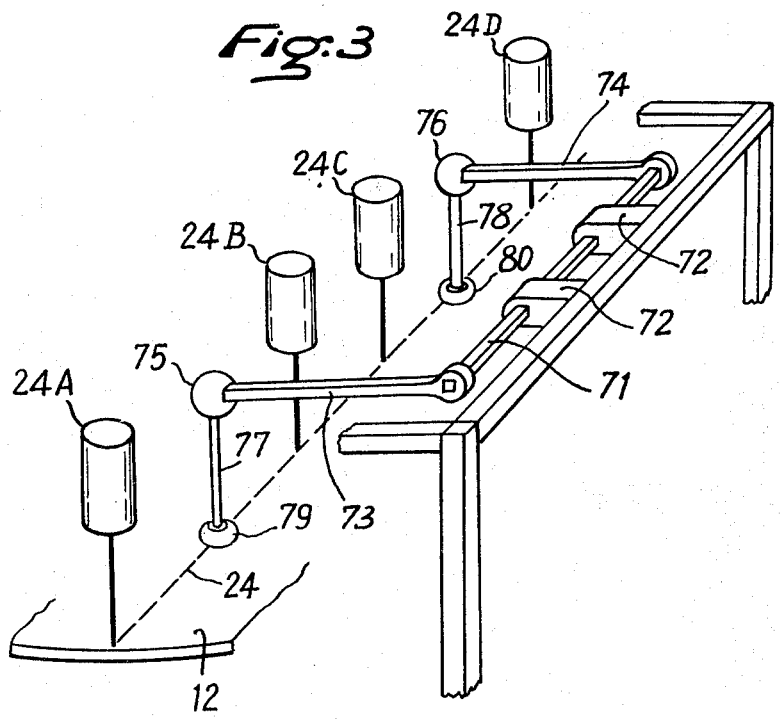
FIG. 3 is a schematic view in perspective of the stabilization system of the upper plate.

Whatever the means used to synchronize the descent and flattening of the upper plate with the lowering of the pressure, it is difficult to synchronize the displacements of the jacks. In accordance with the invention, means are provided to maintain the upper plate horizontal on the average. FIG. 3 shows the arrangement which exerts a retracting force on the upper plate if its position deviates from the horizontal. The system utilizes a torsion bar 71 mounted free to rotate on the supports 72 attached to the frame of the press. The bar 71 may rotate freely but its direction is held fixed. The bar is connected to plate 12 at its two ends by two levers 73, 74 articulated at 75, 76 on two links 77, 78, themselves articulated at 79, 80 on the plate 12, at two points sufficiently far from the median line 24 of plate 12, along which the jacks 24A, 24B, 24C, and 24D are disposed. It is seen that if the axis 24 of plate 12 tilts with respect to the horizontal, the links 77 and 78 will impart a differential rotation to levers 73 and 74 which will develop torsion in the bar 71. The torsion will exert a reaction which tends to bring plate 12 level again. The articulations 75, 76, 79 and 80 may be swivel joints, to permit a slight inclination of plate 12, or simple articulations with sufficient play to allow a slight tilt of the plate.

Once lowered, the jacks remain pressurized during the time necessary for treatment of the panel. When the heating under pressure is concluded, the upper plate is raised in the following manner.

The evacuation line 20 is opened to the atmosphere. Ambient air penetrates to the periphery of the press. The pressure is allowed to build up. Then the jacks in the outer rows 22 and 26 are raised to pull the edges of the press apart. When the edges are separated, the jacks in the adjacent rows 23 and 25 are raised. Following this, the jacks in the central row 24 are raised. To this end, some of the jacks can have end-of-travel detectors which sense when the lifting of a jack is completed and give the command for raising one or more other rows. These detectors can be simple mechanical devices since the raised positions of the jacks do not depend on the thickness of the panels treated.

In known methods, where the vacuum is maintained during the entire process, it has not been possible to obtain satisfactory surfaces.

The method of the present invention permits obtaining a product with a satisfactory surface, which has led to considerable commercial success, the panels being able, for example, to replace sheet aluminum or steel for containers. The condition of the surface obtained and the solidity of the material obtained confer exceptional qualities on the panels which can be produced at a competitive price, owing to the method of the invention, which, among other things, explains the commercial success encountered.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. A press for fabricating laminated panels having at least one layer of plastic material to be heat treated comprising, a rigid lower plate and an upper plate flexible along a direction of the generatrices, rows of jacks disposed parallel to the generatrix direction to force the flexible plate downwards into a planar form or a flexed form, means disposed at the peripheries of the plates to form a seal between them when sufficiently close together, means for producing a vacuum between the plates, means for connecting said vacuum means to said rows of jacks, means through said connecting means for regulating the lowering of said rows of jacks as a function of the lowering of the pressure between the plates.

2. A press as in claim 1 wherein said regulating means comprises a means responsive to the position of the plates when the center part of the upper plate is placed in position for pressing, a manometer for constantly measuring the pressure inside the press and controls responsive to said manometer measurements for initiating the lowering of different jacks as a function of the pressure inside the press.

3. A press as in claim 1 wherein said connecting means comprises a pressure sensor means connected to lines for exhausting certain jacks to the atmosphere to permit detection of the end of travel of a jack position and for then generating a signal.

4. A press as in claim 1 further comprising end-of-travel detector means for commanding the successive retraction of rows of jacks.

5. A press as in claim 1 further comprising a torsion bar for preventing the upper plate from tilting with respect to the horizontal, the torsion bar being rotatably mounted on supports attached to the frame of the press with the two ends thereof fixed to levers connected by links at two points of the press.

* * * * *